US010322850B2

(12) United States Patent
Koefelda et al.

(10) Patent No.: US 10,322,850 B2
(45) Date of Patent: Jun. 18, 2019

(54) BAKERY TRAY

(75) Inventors: Gerald R. Koefelda, Sunningdale (GB); Alan J. Cook, Liverpool (GB)

(73) Assignee: Rehrig Pacific Company, Los Angeles, CA (US)

( * ) Notice: Subject to any disclaimer, the term of this patent is extended or adjusted under 35 U.S.C. 154(b) by 918 days.

(21) Appl. No.: 13/429,507

(22) Filed: Mar. 26, 2012

(65) Prior Publication Data

US 2012/0241349 A1 Sep. 27, 2012

Related U.S. Application Data

(60) Provisional application No. 61/467,954, filed on Mar. 25, 2011.

(51) Int. Cl.

| | |
|---|---|
| ***B65D 1/34*** | (2006.01) |
| ***B65D 21/04*** | (2006.01) |
| ***B65D 1/36*** | (2006.01) |
| ***B65D 21/06*** | (2006.01) |
| ***B65D 85/36*** | (2006.01) |

(52) U.S. Cl.

CPC ..... *B65D 21/045* (2013.01); *B65D 1/34* (2013.01); *B65D 1/36* (2013.01); *B65D 21/066* (2013.01); *B65D 85/36* (2013.01)

(58) Field of Classification Search

CPC . B65D 25/04; B65D 1/36; B65D 1/24; B65D 25/103; B65D 25/107; A21B 3/133; A21B 3/134; A21B 3/155; A21B 3/138; A21B 3/139; A21C 13/00

USPC .... 220/507, 23.2, 573.1; 206/503, 561, 564, 206/518, 538, 505, 507; 99/426, 249, 99/450, 441

See application file for complete search history.

(56) References Cited

U.S. PATENT DOCUMENTS

| | | | | |
|---|---|---|---|---|
| 1,336,292 | A * | 4/1920 | Goodfriend | 220/23.2 |
| 1,568,742 | A * | 1/1926 | Jung | 249/133 |
| 1,623,692 | A * | 4/1927 | Lockwood | 220/23.2 |

(Continued)

FOREIGN PATENT DOCUMENTS

| | | |
|---|---|---|
| AU | 2004100505 | 7/2004 |
| AU | 2009 222 632 A1 | 4/2010 |

(Continued)

OTHER PUBLICATIONS

European Search Report for EP Application No. 12161353.3, dated Jun. 6, 2012.

(Continued)

*Primary Examiner* — Shawn M Braden

(74) *Attorney, Agent, or Firm* — Carlson, Gaskey & Olds, P.C.

(57) ABSTRACT

A bakery tray includes a base and a pair of opposed side walls extending upward from side edges of the base. Front and rear walls extend upward from front and rear edges of the base. A plurality of recesses for receiving bakery items therein are formed in the base. This increases the number of bakery items that can be received in the tray and/or permits a decrease in the stacking height of the trays, thereby permitting another tray to be received on the stack. In one embodiment, the recesses are a plurality of parallel troughs formed in an upper surface of the base. In another embodiment, the plurality of recesses are formed in the ribs in the base, such that the bakery items are received in the recesses.

20 Claims, 15 Drawing Sheets

(56) References Cited

U.S. PATENT DOCUMENTS

| | | | | | |
|---|---|---|---|---|---|
| 1,671,450 | A | * | 5/1928 | Ross | 99/447 |
| 1,730,919 | A | * | 10/1929 | Debs | 220/23.2 |
| 1,840,310 | A | * | 1/1932 | Debs | 220/23.2 |
| 1,953,935 | A | * | 4/1934 | Jackson | 220/23.6 |
| 2,123,837 | A | * | 7/1938 | Thomas | 211/85.31 |
| 2,150,623 | A | * | 3/1939 | Jackson | 220/23.2 |
| 3,155,268 | A | | 11/1964 | Fogerty et al. | |
| 3,164,478 | A | | 1/1965 | Bostrom | |
| 3,270,913 | A | | 9/1966 | Bridenstine | |
| RE26,350 | E | | 2/1968 | Wilson | |
| 3,392,875 | A | | 7/1968 | Bockenstette | |
| 3,420,402 | A | | 1/1969 | Frater | |
| 3,438,544 | A | | 4/1969 | Cloyd | |
| 3,478,998 | A | * | 11/1969 | Burford | 249/120 |
| 3,613,943 | A | | 10/1971 | Bridenstine | |
| D224,366 | S | | 7/1972 | Houston | |
| 3,675,815 | A | | 7/1972 | Rehrig | |
| 3,780,905 | A | | 12/1973 | Herolzer | |
| 3,825,114 | A | | 7/1974 | Johnson et al. | |
| 3,828,705 | A | * | 8/1974 | Morrison | 72/332 |
| 3,865,239 | A | | 2/1975 | Herolzer | |
| 3,937,327 | A | | 2/1976 | Carroll | |
| 3,951,265 | A | | 4/1976 | Carroll | |
| 4,000,817 | A | | 1/1977 | Sanders et al. | |
| 4,023,680 | A | | 5/1977 | Thurman | |
| D247,648 | S | | 3/1978 | Carroll | |
| 4,093,070 | A | | 6/1978 | Stahl | |
| 4,093,071 | A | | 6/1978 | Stahl et al. | |
| 4,102,453 | A | | 7/1978 | Carroll et al. | |
| D249,185 | S | | 8/1978 | Carroll | |
| 4,106,624 | A | | 8/1978 | Thurman | |
| 4,106,625 | A | | 8/1978 | Carroll et al. | |
| 4,109,791 | A | | 8/1978 | Clipson | |
| D252,961 | S | | 9/1979 | Carroll | |
| 4,189,052 | A | | 2/1980 | Carroll et al. | |
| 4,238,032 | A | | 12/1980 | Thurman | |
| 4,320,837 | A | | 3/1982 | Carroll et al. | |
| 4,364,477 | A | | 12/1982 | Stromberg | |
| 4,379,508 | A | | 4/1983 | Miller et al. | |
| 4,423,813 | A | | 1/1984 | Kreeger et al. | |
| 4,519,503 | A | | 5/1985 | Wilson | |
| 4,522,301 | A | | 6/1985 | Ajmera | |
| 4,523,681 | A | | 6/1985 | Kreeger | |
| 4,759,451 | A | * | 7/1988 | Apps | 211/126.4 |
| 4,807,756 | A | | 2/1989 | Young et al. | |
| 4,885,989 | A | * | 12/1989 | Korpan | 99/450 |
| 4,899,884 | A | | 2/1990 | Madsen | |
| 4,936,458 | A | | 6/1990 | Tabler | |
| 4,960,207 | A | | 10/1990 | Tabler et al. | |
| 4,960,211 | A | * | 10/1990 | Bailey | 211/60.1 |
| 4,982,844 | A | | 1/1991 | Madan et al. | |
| 5,035,236 | A | | 7/1991 | Kanegaonkar | |
| 5,035,326 | A | | 7/1991 | Stahl | |
| D319,908 | S | | 9/1991 | Stahl | |
| 5,080,314 | A | * | 1/1992 | Moyer et al. | 248/346.4 |
| 5,232,609 | A | | 8/1993 | Prevost et al. | |
| 5,287,966 | A | | 2/1994 | Stahl et al. | |
| 5,292,001 | A | | 3/1994 | Langenbeck et al. | |
| D348,138 | S | | 6/1994 | Lang-Ree | |
| D348,344 | S | | 6/1994 | Apps | |
| D350,028 | S | | 8/1994 | Apps | |
| 5,344,022 | A | | 9/1994 | Stahl | |
| 5,372,257 | A | | 12/1994 | Beauchamp et al. | |
| 5,581,902 | A | | 12/1996 | Didion et al. | |
| 5,582,296 | A | | 12/1996 | Beauchamp et al. | |
| 5,615,921 | A | | 4/1997 | Marley et al. | |
| 5,881,902 | A | | 3/1999 | Ackermann et al. | |
| 5,896,992 | A | | 4/1999 | McGrath | |
| 5,921,566 | A | | 7/1999 | Kern et al. | |
| 5,979,654 | A | | 11/1999 | Apps et al. | |
| D439,049 | S | | 3/2001 | Koefelda | |
| 6,260,706 | B1 | | 7/2001 | Koefelda | |
| D446,939 | S | | 8/2001 | Koefelda | |
| 6,273,259 | B1 | | 8/2001 | Stahl | |
| 6,394,274 | B1 | | 5/2002 | Cheeseman | |
| 6,607,199 | B2 | | 8/2003 | Gruber | |
| 6,857,642 | B2 | | 2/2005 | Gruber | |
| 6,886,710 | B2 | | 5/2005 | Verna et al. | |
| 6,953,116 | B2 | | 10/2005 | Verna et al. | |
| 7,258,246 | B2 | | 8/2007 | Tingley | |
| 7,320,405 | B2 | | 1/2008 | Stahl | |
| 7,484,621 | B2 | | 2/2009 | Apps et al. | |
| D598,684 | S | | 8/2009 | Stahl | |
| 7,637,373 | B2 | | 12/2009 | Stahl | |
| 7,686,167 | B1 | | 3/2010 | Stahl | |
| 7,784,615 | B2 | | 8/2010 | Stahl | |
| 7,823,728 | B2 | | 11/2010 | Baltz | |
| 7,861,864 | B2 | | 1/2011 | Hassell et al. | |
| 2002/0153682 | A1 | | 10/2002 | Gruber | |
| 2003/0183549 | A1 | | 10/2003 | Verna et al. | |
| 2003/0205495 | A1 | | 11/2003 | Verna et al. | |
| 2004/0050742 | A1 | | 3/2004 | Gruber | |
| 2004/0060844 | A1 | | 4/2004 | Stahl | |
| 2004/0144680 | A1 | | 7/2004 | Stahl | |
| 2005/0183980 | A1 | | 8/2005 | Fernandez | |
| 2006/0070906 | A1 | | 4/2006 | Verna | |
| 2007/0175790 | A1 | | 8/2007 | Fernandez | |
| 2007/0187276 | A1 | | 8/2007 | Stahl | |
| 2007/0187420 | A1 | | 8/2007 | Gruskin et al. | |
| 2008/0116099 | A1 | | 5/2008 | Garcia | |
| 2008/0116100 | A1 | | 5/2008 | Hassell et al. | |
| 2010/0000900 | A1 | | 1/2010 | Hassell | |
| 2010/0084304 | A1 | | 4/2010 | Cavalcante | |
| 2011/0037237 | A1 | | 2/2011 | Hassell | |

FOREIGN PATENT DOCUMENTS

| | | | | | |
|---|---|---|---|---|---|
| DE | 200 13 147 | U1 | | 11/2000 | |
| EP | 1911682 | A1 | | 4/2008 | |
| EP | 2284089 | A2 | | 2/2011 | |
| FR | 2266638 | A1 | | 10/1975 | |
| FR | 2756706 | A1 | * | 6/1998 | A21B 3/155 |
| FR | 2 851 552 | A1 | | 8/2004 | |
| GB | 1203403 | A | | 8/1970 | |
| WO | 9903745 | A1 | | 1/1999 | |
| WO | 02094665 | A1 | | 11/2002 | |
| WO | 03039980 | A1 | | 5/2003 | |

OTHER PUBLICATIONS

Canadian Office Action for Application No. CA 2,772,393 dated Dec. 19, 2018.

* cited by examiner

BAKERY TRAY

This application claims priority to U.S. Provisional Application Ser. No. 61/467,954, filed Mar. 25, 2011.

BACKGROUND

Bakery trays typically include a base wall, a pair of opposed side walls extending upward from side edges of the base, and front and rear walls extending upward from front and rear edges of the base. Loaded bakery trays can be stacked upon one another such that the weight of the loaded trays is supported on the walls of the trays, not the bakery items in the trays.

The trays themselves contribute to the height of the stack of loaded trays. This could limit, for example, the number of trays in a stack that can fit in a truck for shipping or the amount of product that can fit inside each tray.

SUMMARY

A bakery tray includes a base and a pair of opposed side walls extending upward from side edges of the base. Front and rear walls extend upward from front and rear edges of the base. A plurality of recesses for receiving bakery items therein are formed in the base. This increases the number of bakery items that can be received in the tray and/or permits a decrease in the stacking height of the trays, thereby permitting another tray to be received on the stack.

In one embodiment, the recesses are a plurality of parallel troughs formed in an upper surface of the base.

In another embodiment, the plurality of recesses are formed in the ribs in the base, such that the bakery items are received in the recesses.

DETAILED DESCRIPTION OF THE PREFERRED EMBODIMENT

Figure 1:
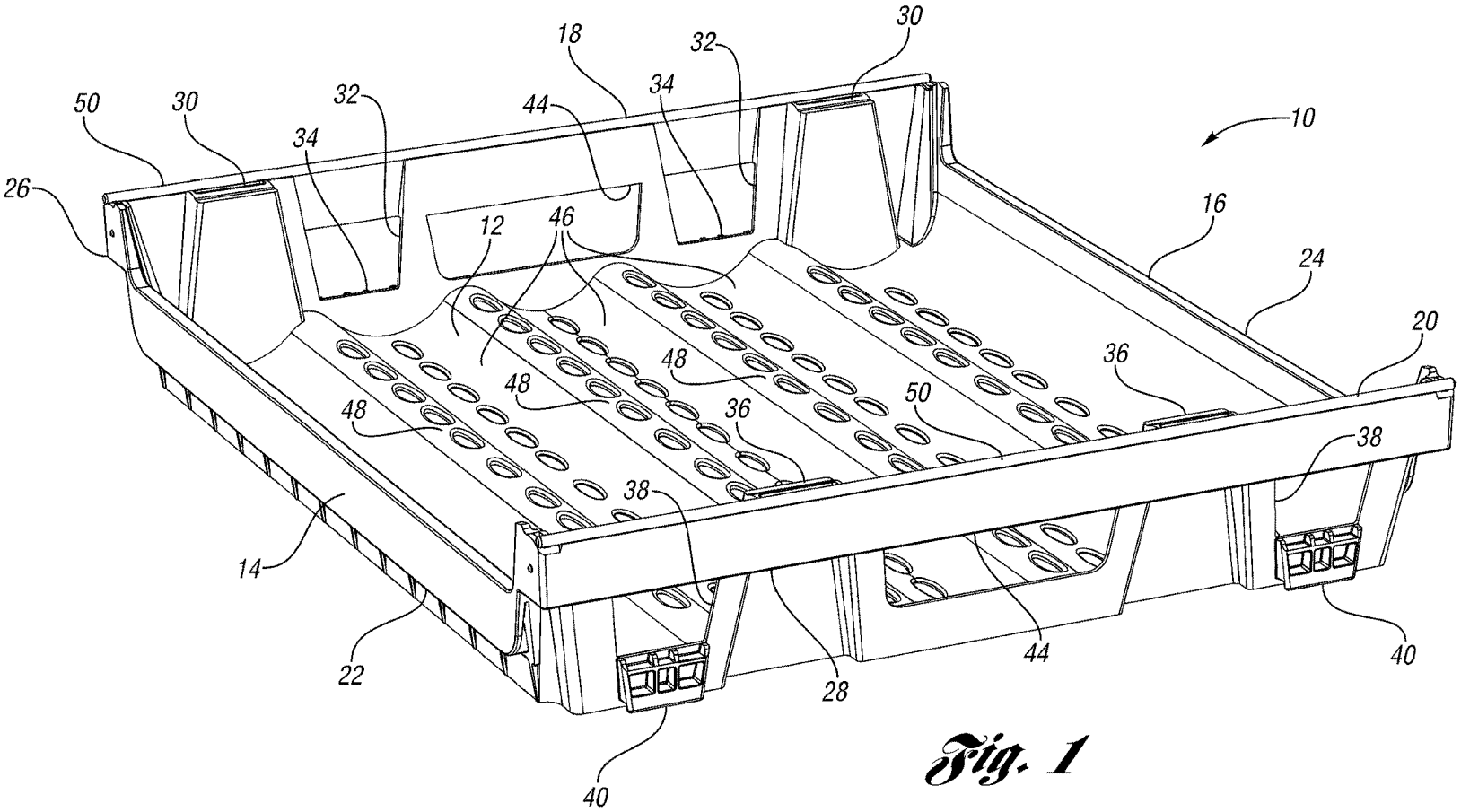
FIG. 1 is perspective view of a bakery tray according to a first embodiment.

A bakery tray 10 according to one embodiment of the present invention is shown in FIG. 1. The bakery tray 10 generally includes a base 12, a front wall 14 and a rear wall 16 extending upwardly from front and rear edges of the tray 10. Side walls 18, 20 extend upwardly from side edges of the base 12. The upper edge of the front and rear walls 14, 16 have a lip 22, 24. The upper edge of the side walls 18, 20 each have a lip 26, 28. The front wall 14 may be significantly shorter than the side walls 18, 20, as shown. The rear wall 16 may also be significantly shorter than the side walls 18, 20, as shown.

The side wall 18 has a pair of outer towers 30 and a pair of inner windows 32. A foot 34 protrudes outwardly from the side wall 18 below each inner window 32. The side wall 20 has a pair of inner towers 36 and a pair of outer windows 38. A foot 40 protrudes outwardly from the side wall 20 below each outer window 38. Each side wall 18, 20 includes a handle opening 44.

The base 12 has a wavy or corrugated configuration, such that it includes a plurality of parallel elongated recesses or troughs 46 and a plurality of parallel elongated peaks 48. A pair of supports 50 are pivotably secured to the tray 10 and pivotable between an outward retracted position (shown in FIG. 1) and an extended or inward deployed position (shown in FIG. 8). The supports 50 may be pivotably connected to the front and rear walls 14, 16 as shown or could be pivotably and/or slidably mounted to the side walls 18, 20.

Figure 2:
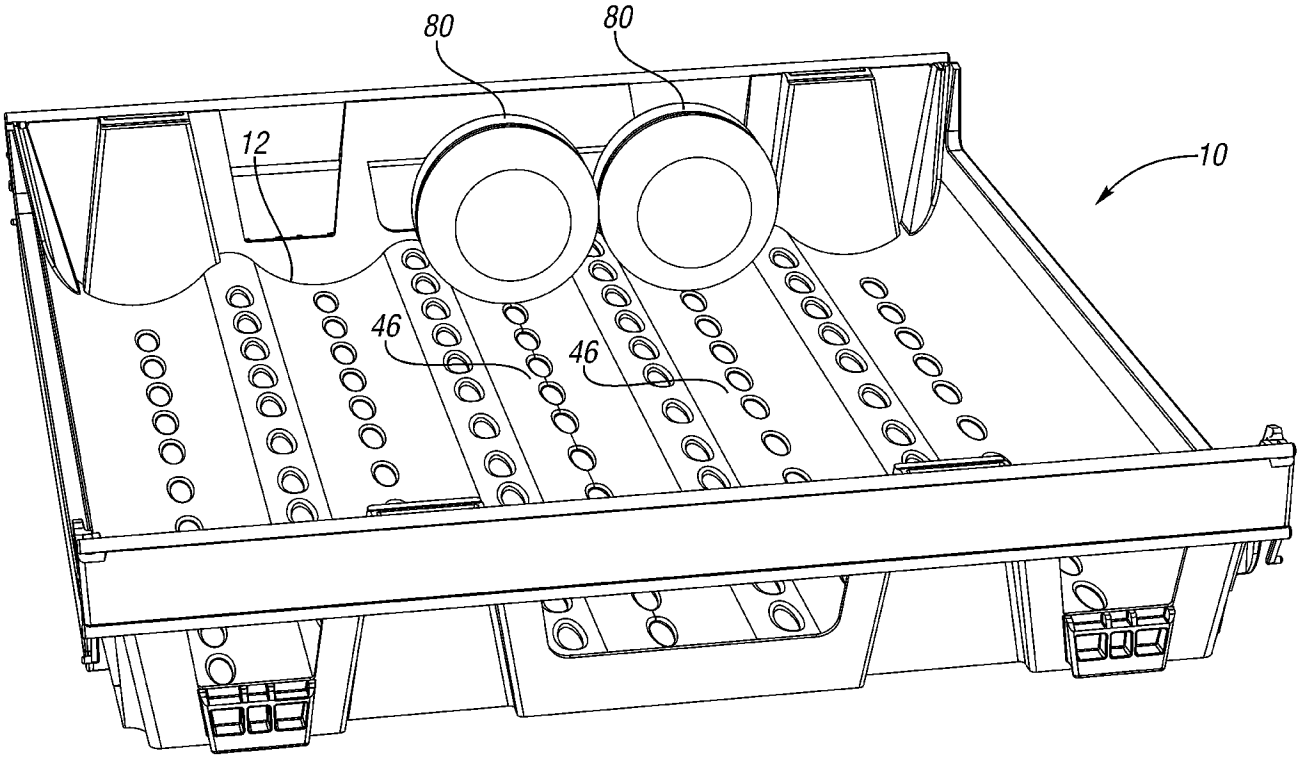
FIG. 2 shows the bakery tray of FIG. 1 with baked items stored therein.
Figure 11:
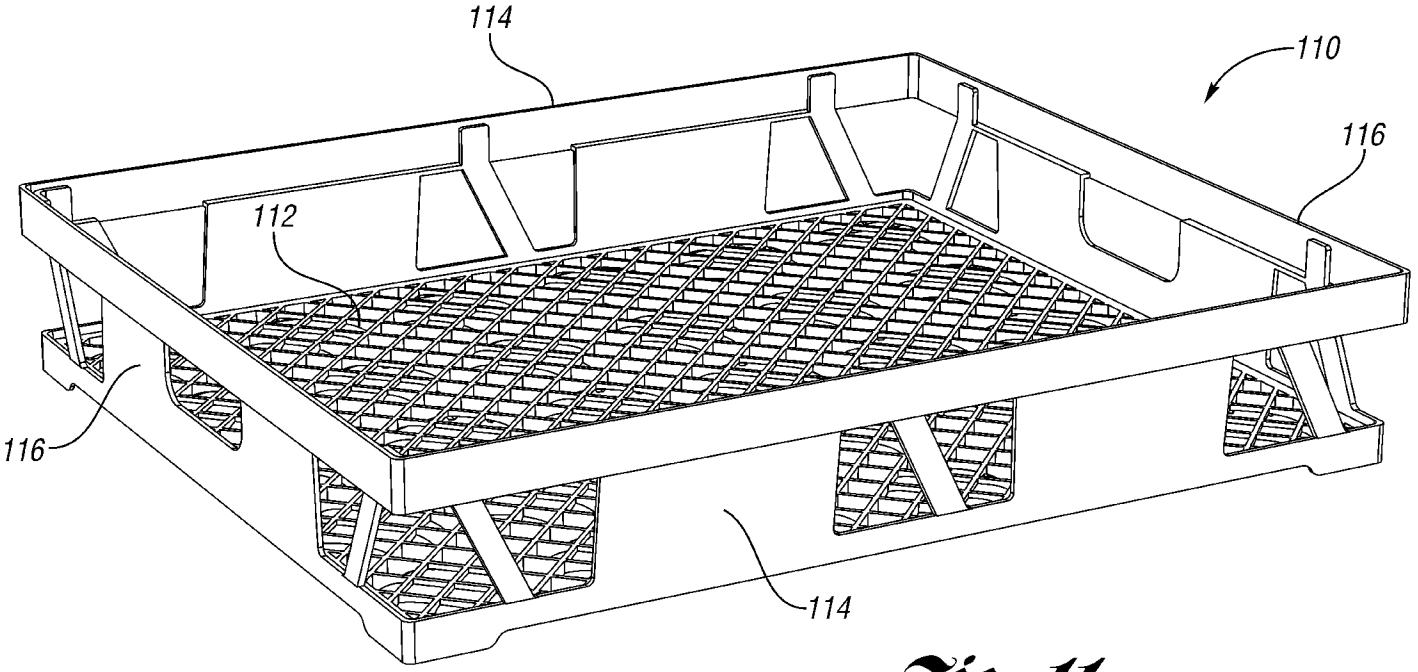
FIG. 11 is a perspective view of a bakery tray according to a second embodiment.

Referring to FIG. 2, the parallel troughs 46 can accommodate certain shapes of bakery items well, such as hamburger buns 80 (or sandwich buns, or rolls, or the like). As shown, the buns 80 can be efficiently loaded into the tray 10 on end (i.e. the halves of the bun and the slice through the bun is perpendicular to the floor). The corrugations in the base 12 permit the troughs 46 of the base 12 to be as low as possible within the tray 10. For example, as shown in FIG. 11, the base 12 is only the single wall thickness thick at the bottom of the trough 46. The upper surface of the bottom wall of the trough 46 defines the trough 46 while the bottom surface of the bottom wall of the trough 46 is the bottom of the tray 10. This means that stacked trays 10 could be nested such that there is only the thickness of the base wall between the layers of bakery items, i.e. there are no ribs between layers of bakery items in different trays 10. Alternatively, there could be very small ribs.

Figure 3:
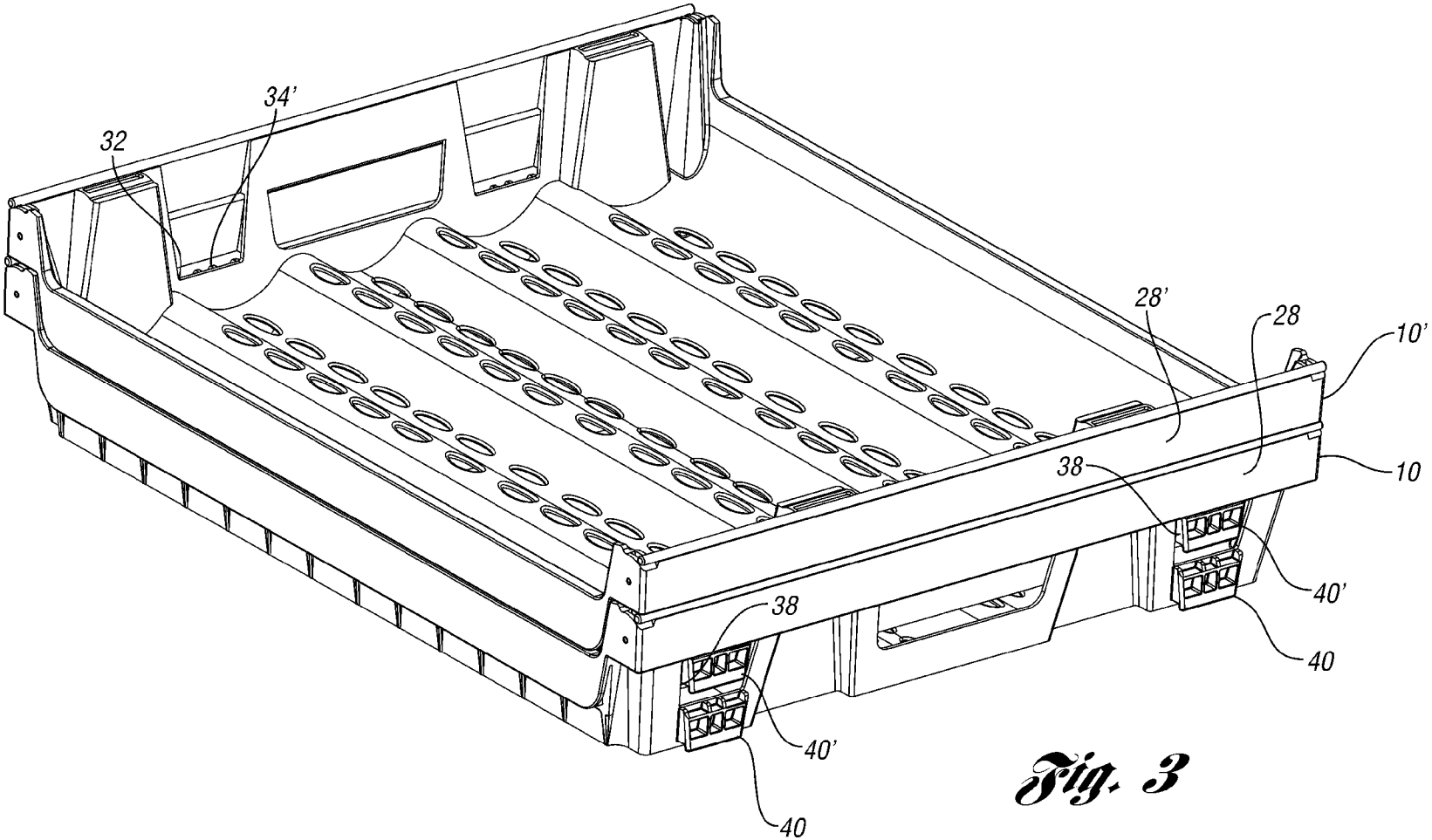
FIG. 3 shows a pair of the bakery trays of FIG. 1 nested together.
Figure 4:
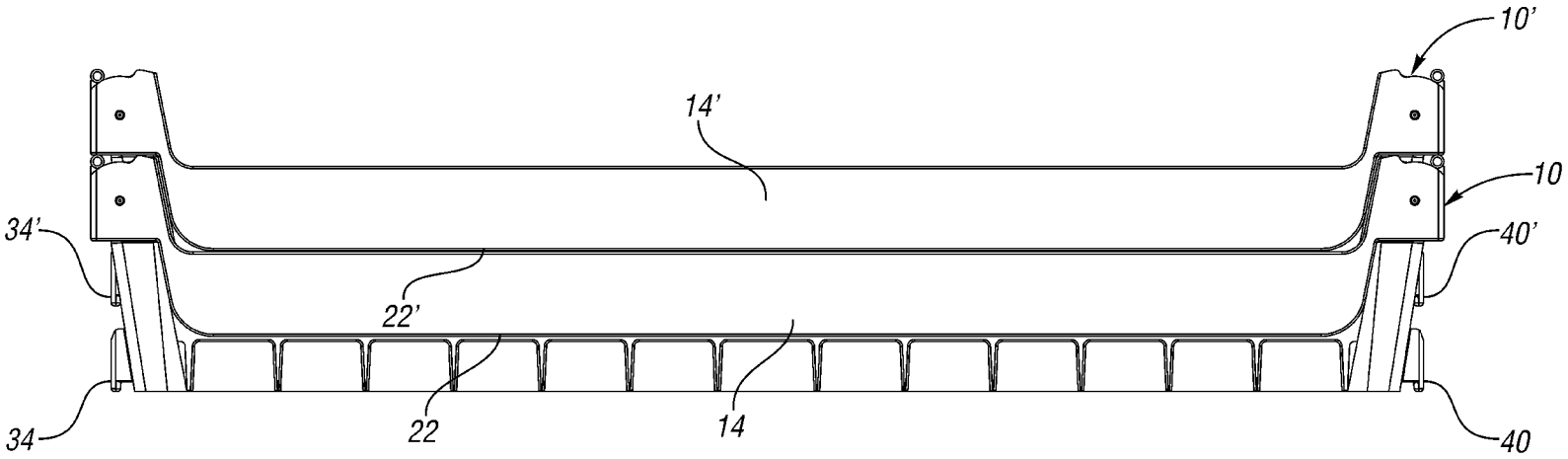
FIG. 4 is a front view of the bakery trays of FIG. 3.

The example tray 10 is a 180 degree stack/nest tray 10. As shown in FIG. 3, an identical tray 10' can be nested in the tray 10 when they are oriented similarly, such that the feet 40' of the upper tray 10' are received in the windows 38 of the lower tray 10. The feet 34' of the upper tray 10' would also be received in the windows 32 of the lower tray 10. The lip 28' of the upper tray 10' abuts the lip 28 of the lower tray 10, for maximum storage and shipping efficiency when empty. FIG. 4 is a front view of the trays 10, 10' of FIG. 3.

Figure 5:
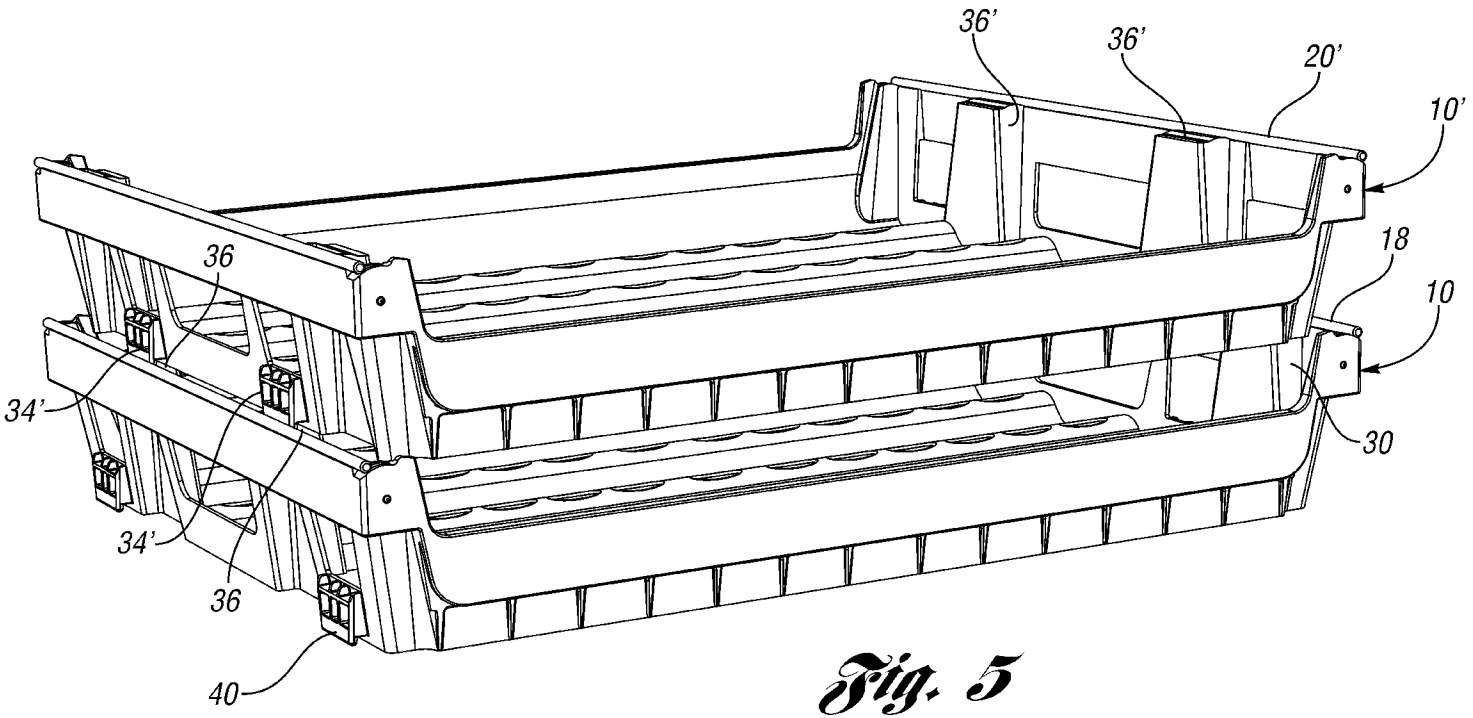
FIG. 5 shows the bakery trays of FIG. 3 in a low-stack orientation.
Figure 6:
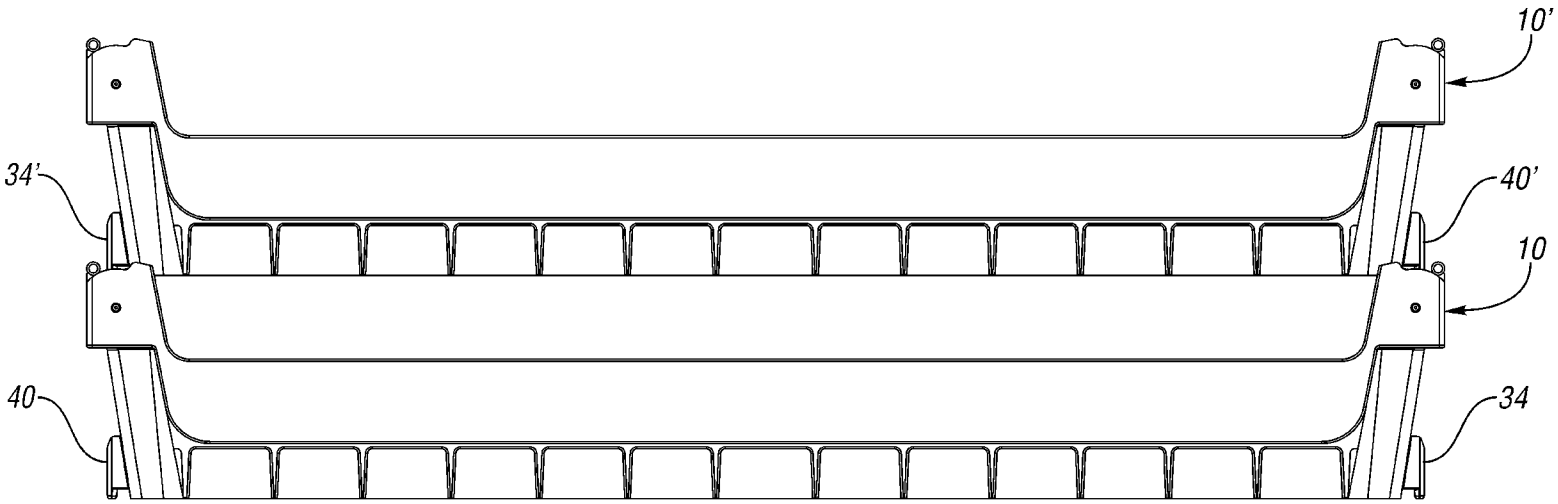
FIG. 6 is a front view of the bakery trays of FIG. 5.
Figure 7:
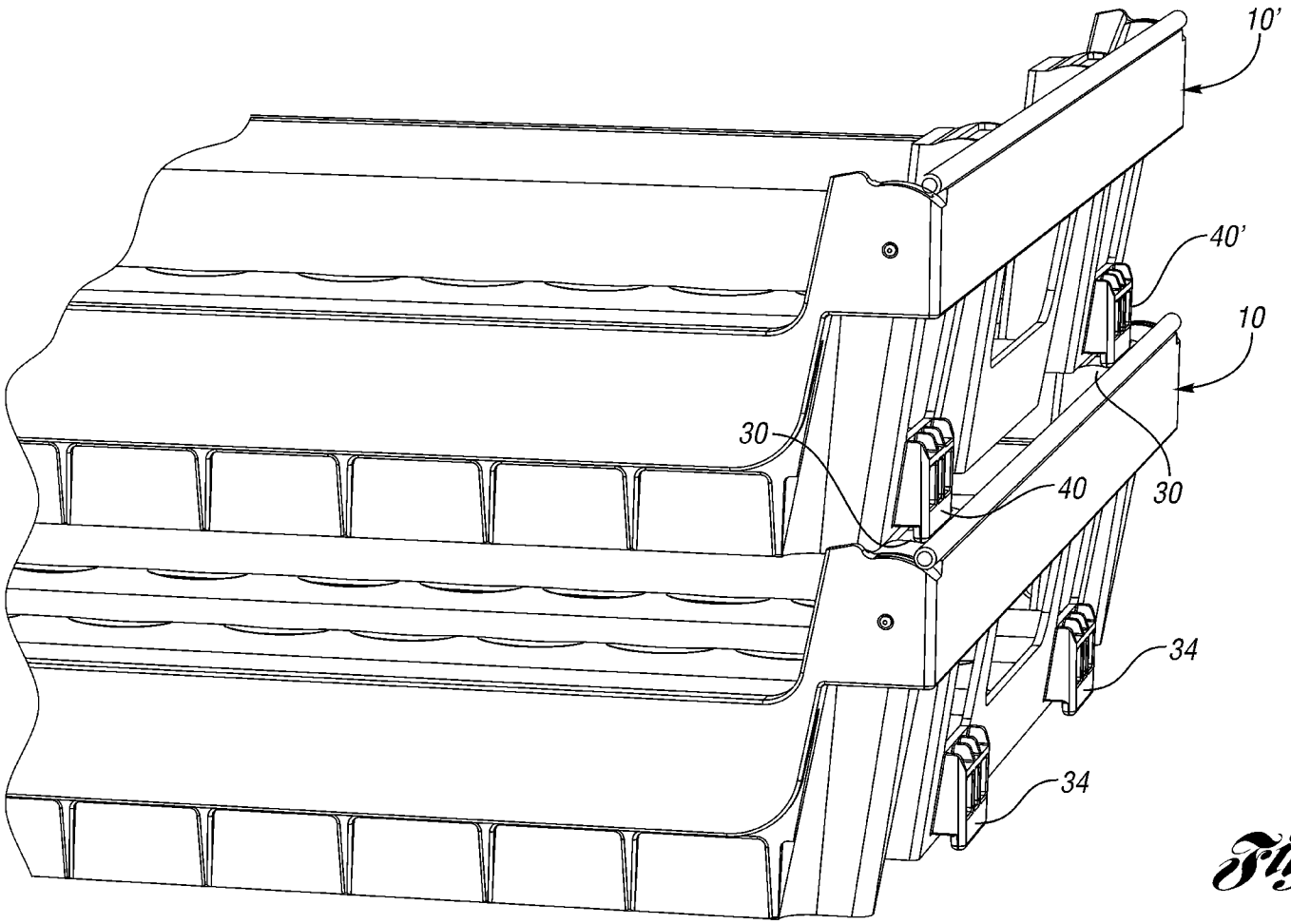
FIG. 7 is an enlarged perspective view of one end of the bakery trays of FIG. 5.

As shown in FIGS. 5-7, when the upper tray 10' is rotated 180 degrees relative to the lower tray 10, the inner feet 34' of the upper tray 10' stack on the inner towers 36 of the lower tray 10, while the outer feet 40' of the upper tray 10' stack on the outer towers 30 of the lower tray 10. The supports 50 of the lower tray 10 are outward of the feet 34', 40' and the feet 34', 40' are not supported on the supports 50. The trays 10, 10' are in the low-stack orientation. This is how the trays 10, 10' would be stacked when loaded with bakery items, such as buns.

Figure 8:
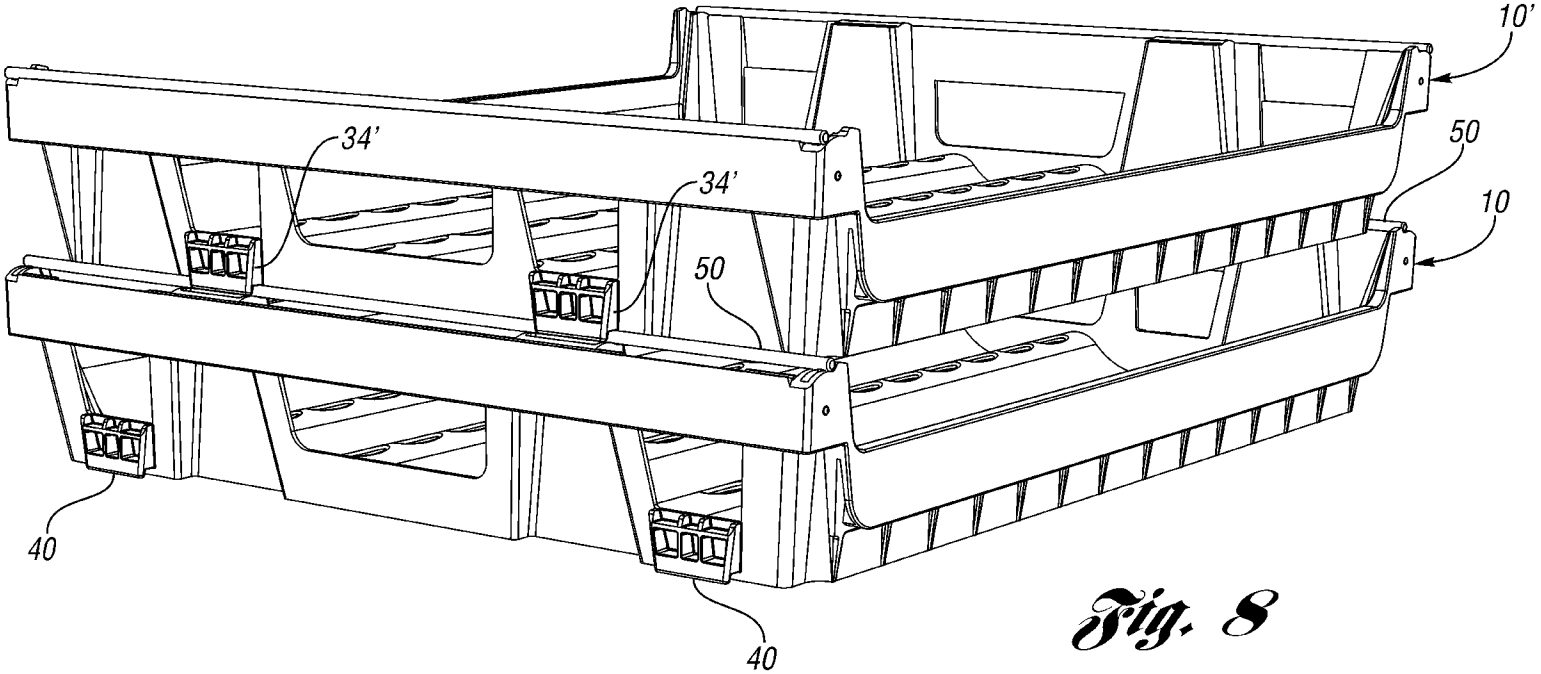
FIG. 8 is a perspective view of the trays of FIG. 5 in the high-stack orientation.
Figure 9:
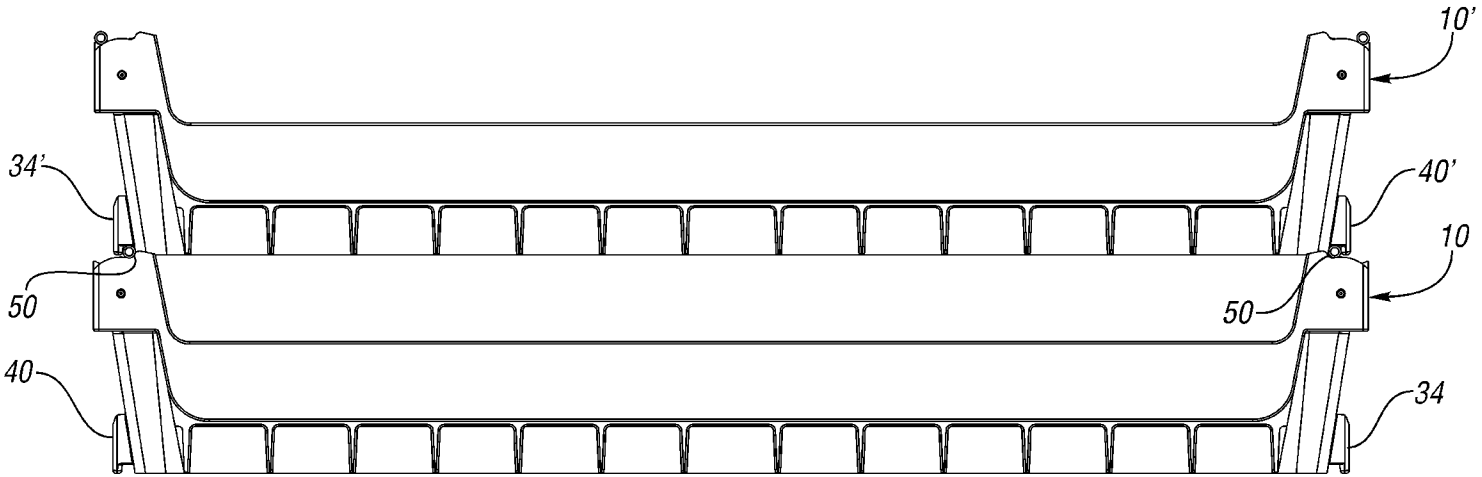
FIG. 9 is a front view of the bakery trays of FIG. 8.

As shown in FIGS. 8-9, when the supports 50 are moved inward to the deployed position, the feet 34', 40' of the upper tray 10' are supported on the supports 50 of the lower tray 10. This raises the base 12' of the upper tray 10' a little higher (e.g. 5 mm) than the stacked position in FIGS. 5-7. This high-stack orientation could be used to accommodate large bakery items, e.g. larger buns, while still providing the option of the lower stack position (FIGS. 5-7) for smaller bakery items. When stacked in a delivery truck, even an extra 5 mm per tray can provide a large benefit because another layer or two of trays may be able to fit in the truck.

Figure 10:
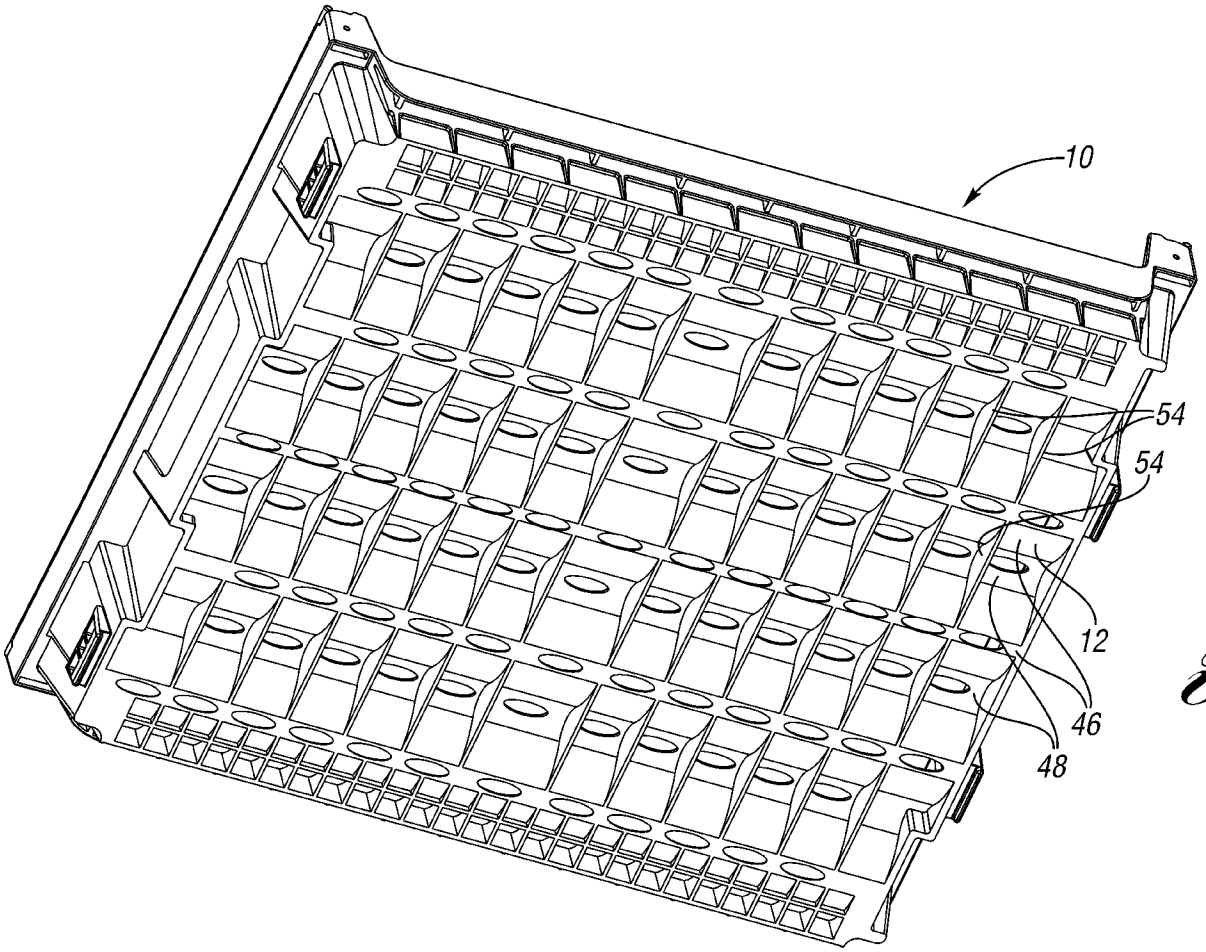
FIG. 10 is a bottom perspective view of the bakery tray of FIG. 1.

FIG. 10 is a bottom view of the tray 10. As shown, the troughs 46 have only a single wall thickness at the bottom of the tray 10, which minimizes the stacked height of loaded trays 10. The peaks 48 may have transverse ribs 54 formed therein for added strength and stability to the base 12.

FIGS. 11-15 illustrate a tray 110 according to a second embodiment of the present invention. The tray 110 includes a base 112. A pair of side walls 114 and a pair of end walls 116 extend upward from the base 112.

Figure 12:
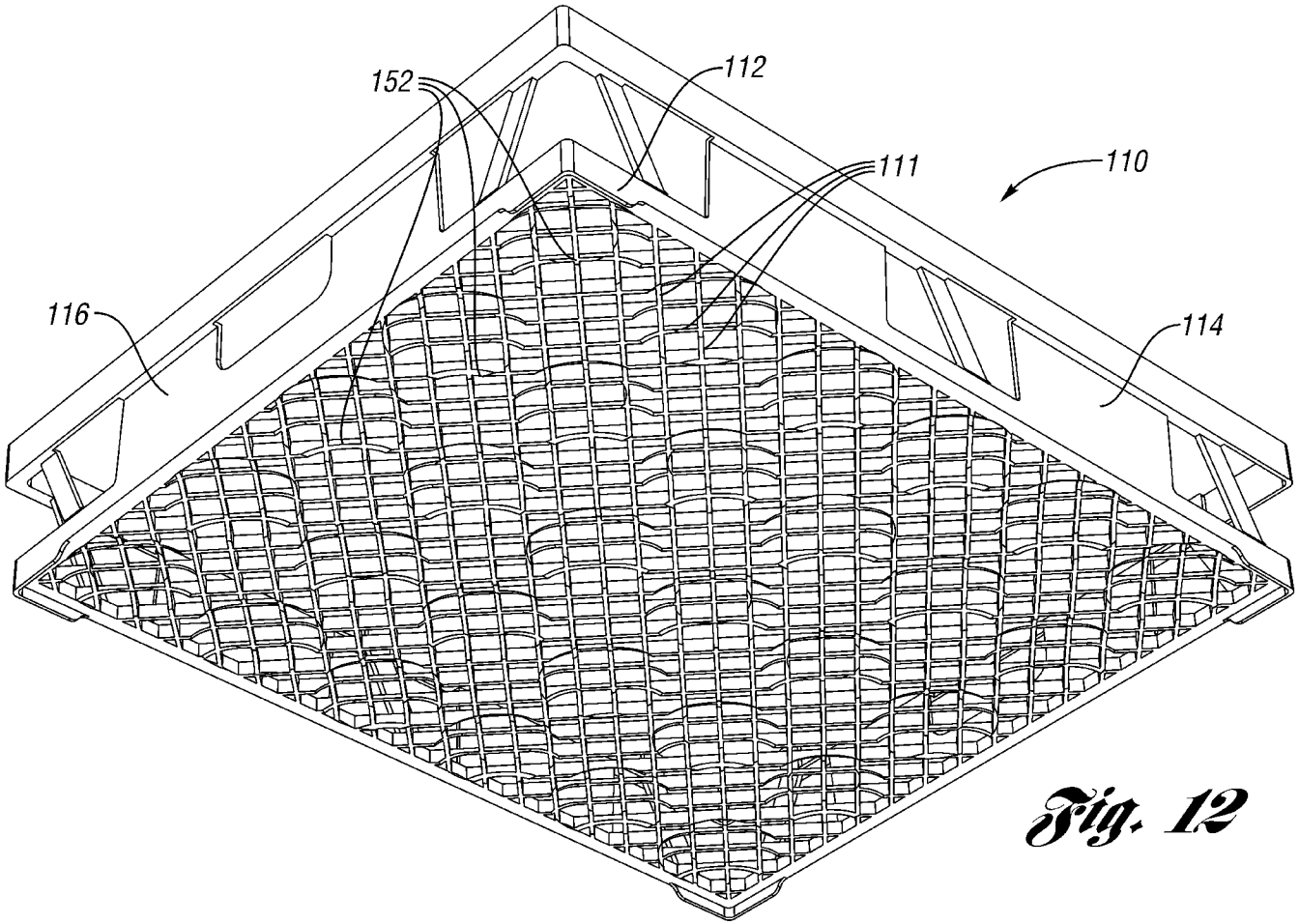
FIG. 12 is a bottom perspective view of the bakery tray of FIG. 11.

FIG. 12 is a bottom perspective view of the tray 110. The base 112 includes a plurality of ribs 111. The ribs 111 may include a plurality of intersecting perpendicular vertical ribs 111. The ribs 111 having scallops or recesses 152 formed at their lower ends. Shortened portions 113 of the ribs 111 form the recesses 152. The recesses 152 are generally sized and positioned in the bottom of the base 112 to partially receive the tops of buns (or other product) in a tray below.

Figure 13:
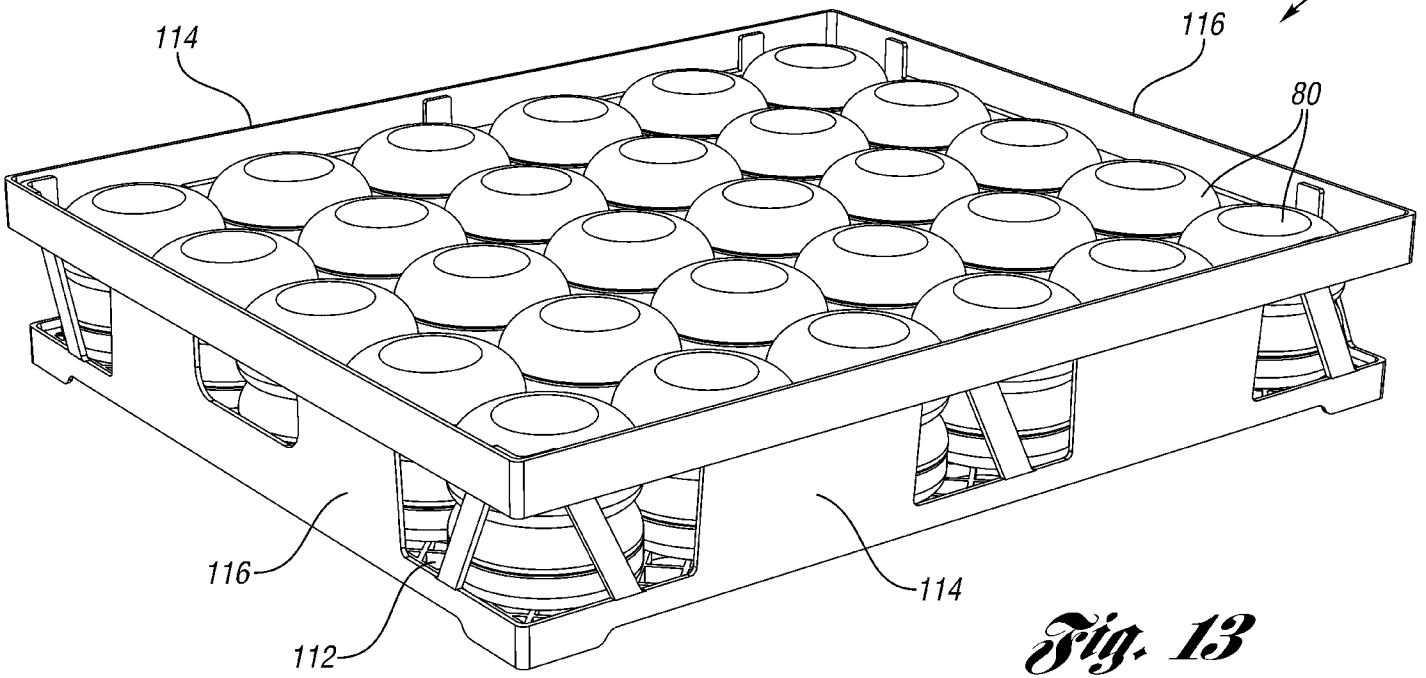
FIG. 13 shows the bakery tray of FIG. 11 loaded with baked items.

As shown in FIG. 13, the tray 110 can be used to ship and store bakery items 80, such as hamburger buns, sandwich buns, rolls, etc. Stacks of such bakery items 80 are arranged within the tray 110.

Figure 14:
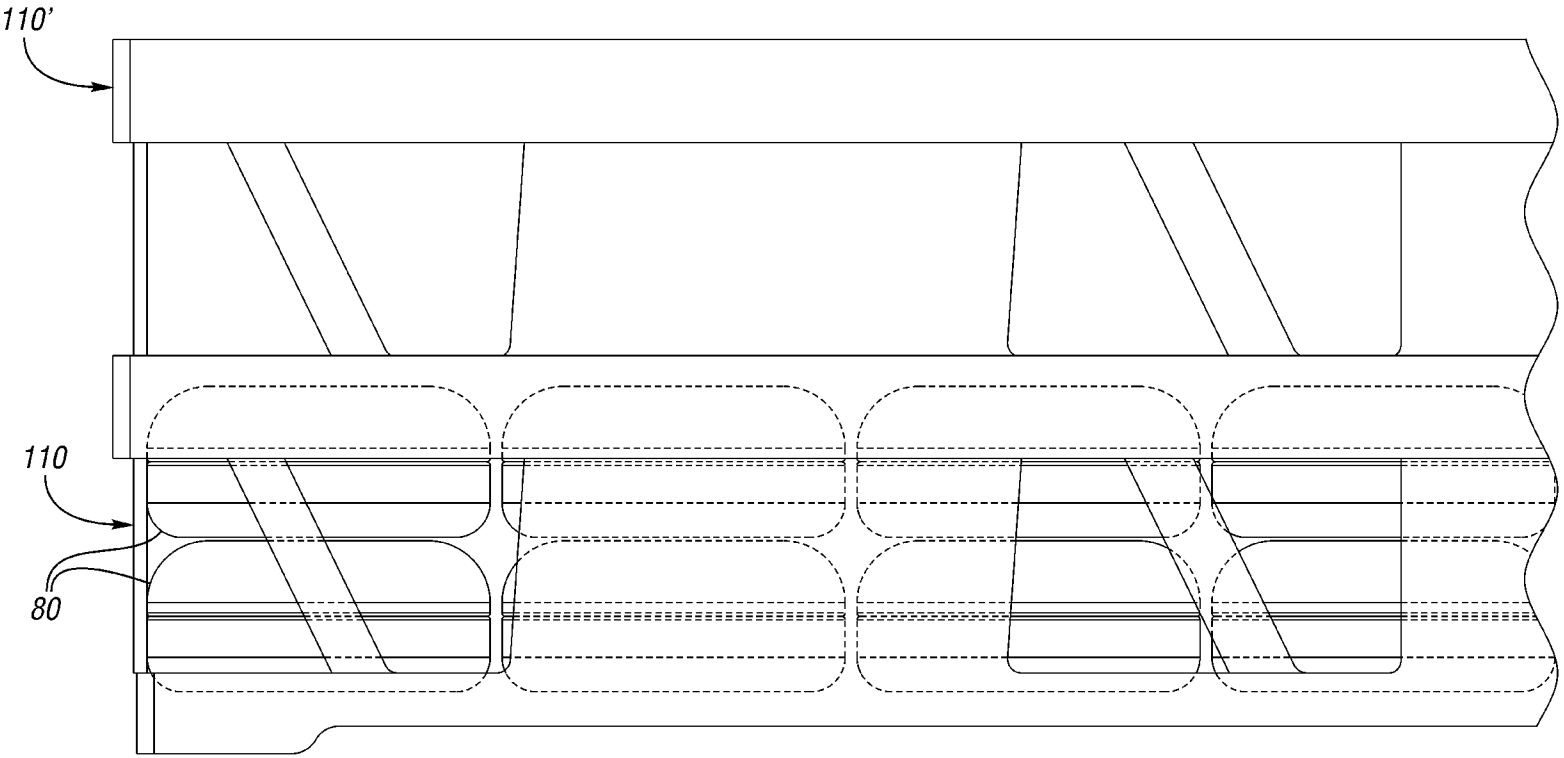
FIG. 14 is a side view of a portion of two stacked bakery trays of FIG. 11.
Figure 15:
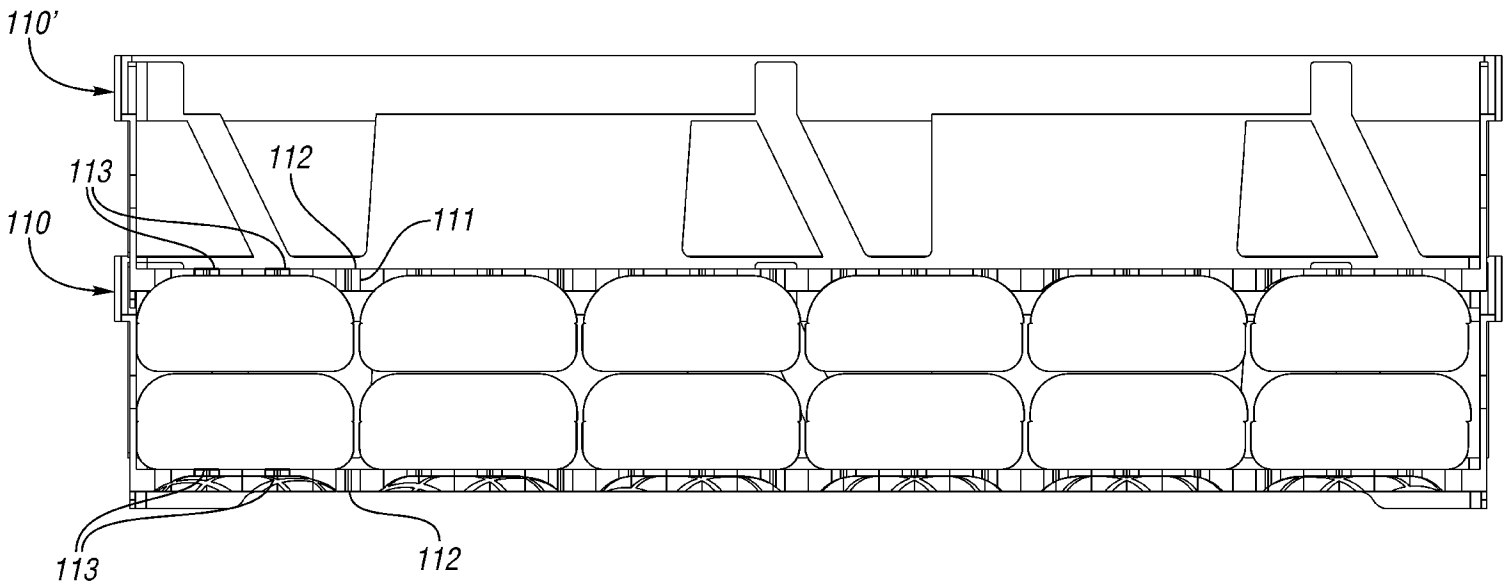
FIG. 15 is a section view of the bakery trays of FIG. 14.

As shown in FIG. 14, an identical tray 110' can be stacked on the tray 110 loaded with bakery items 80 for efficient storage and shipping. FIG. 15 is a section view through the trays 110, 110'. As shown, the plurality of scallops or recesses 152 are formed in the ribs 111 on the underside of the base 112 by the shortened portions 113 of the ribs 111. The recesses 152 define where buns 80 can be received, while the remaining longer portions of the ribs 111 reinforce the base 112.

By forming the scallops in the underside of the base 112, the trays 110, 110' can be designed to stack together at a lower total height. Although it may appear to be a small reduction in height between two trays 110, the overall height reduction of a stack of trays 110 in a delivery truck can be significant enough to permit another layer or two of trays 110 in the truck. Alternatively, another layer of bakery items (e.g. buns) can be stacked in each tray 110. This provides a significant increase in efficiency.

The scallops could be added to almost any style bakery tray and are not limited to the style shown. Also, the shape of the scallops could vary depending on the item in the trays, e.g. elongated channels could be formed for loaves of bread.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray comprising:

a base, the base including a plurality of parallel troughs formed in an upper surface of the base for receiving items therein, a plurality of elongated peaks between each of the troughs, wherein the peaks include a plurality of ribs formed on an underside of the peaks, the plurality of ribs extending transversely to the troughs between adjacent pairs of the plurality of troughs; and a plurality of walls extending upward from the base.

2. The tray of claim 1 wherein a bottom wall of each of the troughs does not have ribs on a bottom surface thereof.

3. The tray of claim 2 wherein the troughs extends from one wall to an opposite wall.

4. The tray of claim 1 wherein the tray can be stacked on an identical tray in a first orientation and the tray can be nested with the identical tray at a second orientation, 180 degrees from the first orientation.

5. The tray of claim 4 wherein the plurality of walls includes a pair of opposed side walls, a front wall and a rear wall and wherein the front wall is significantly shorter than the side walls.

6. A tray comprising:

a base, the base including a plurality of parallel troughs formed in an upper surface of the base for receiving items therein; and a plurality of walls extending upward from the base, wherein the plurality of walls are configured such that the tray can be stacked on an identical tray in a first orientation and can be nested with the identical tray at a second orientation, wherein the second orientation is 180 degrees from the first orientation and wherein the troughs of the tray are parallel to the troughs of the identical tray in the first orientation and the second orientation.

7. The tray of claim 6 wherein one of the plurality of walls includes at least one foot protruding outward therefrom for stacking on the identical tray in the first orientation.

8. The tray of claim 7 wherein the at least one foot is received in a window through one of the plurality of walls of the identical tray when the tray is stacked on the identical tray in the second orientation.

9. The tray of claim 6 wherein two of the plurality of walls each include a pair of towers and a pair of windows adjacent the pair of towers, and wherein the two walls includes at least one foot protruding outward therefrom for stacking on the identical tray in the first orientation and for being received in the pair of windows in the identical tray in the second orientation.

10. The tray of claim 6 further including a pair of supports each pivotably secured to the tray, wherein the tray can be supported on the pair of supports of the identical tray at a height greater than the second orientation.

11. The tray of claim 6 further including a plurality of elongated peaks between each of the troughs, wherein the peaks include a plurality of ribs formed on an underside of the peaks.

12. The tray of claim 11 further including a plurality of spaced-apart apertures formed through each of the elongated peaks.

13. A tray comprising:

a base, the base including a plurality of parallel troughs formed in an upper surface of the base for receiving items therein, a plurality of elongated peaks connecting adjacent pairs of the plurality of troughs to one another, a plurality of spaced-apart apertures formed through each of the elongated peaks; and a plurality of walls extending upward from a perimeter of the base.

14. The tray of claim 13 wherein the troughs are curved.

15. The tray of claim 14 wherein the peaks are curved.

16. A tray comprising:

a base, the base including a plurality of parallel troughs formed in an upper surface of the base for receiving items therein, a plurality of elongated peaks connecting adjacent pairs of the plurality of troughs to one another; and a plurality of walls extending upward from a perimeter of the base; wherein the tray can be stacked on an identical tray in a first orientation and the tray can be nested with the identical tray at a second orientation, wherein the second orientation is 180 degrees from the first orientation.

17. A tray comprising:

a base, the base including a plurality of parallel troughs formed in an upper surface of the base for receiving items therein, a plurality of elongated peaks connecting adjacent pairs of the plurality of troughs to one another; and a plurality of walls extending upward from a perimeter of the base, wherein one of the plurality of walls includes at least one foot protruding outward therefrom for stacking on an identical tray.

18. The tray of claim 1 wherein the upper surface of the base is continuous across the plurality of elongated peaks and the plurality of parallel troughs.

19. The tray of claim 6 wherein the base includes a plurality of elongated peaks, each between an adjacent pair of the plurality of parallel troughs, the plurality of walls include a pair of opposed side walls, wherein the side walls are taller than the plurality of elongated peaks.

20. The tray of claim 13 wherein the plurality of walls are configured such that the tray can be stacked on an identical tray in a first orientation and nested with the identical tray at a second orientation, wherein the second orientation is 180 degrees from the first orientation, wherein two of the plurality of walls each include a pair of towers and a pair of windows adjacent the pair of towers, and wherein the two walls includes at least one foot protruding outward therefrom such that they would stack on an identical tray in the first orientation and such that they would be received in the pair of windows in the identical tray in the second orientation.

* * * * *